United States Patent [19]

Glass

[11] 4,036,584

[45] July 19, 1977

[54] TURBINE

[76] Inventor: Benjamin G. Glass, 3011 Stockett Way, San Diego, Calif. 92117

[21] Appl. No.: 642,169

[22] Filed: Dec. 18, 1975

[51] Int. Cl.[2] ..... F01D 1/36

[52] U.S. Cl. ..... 415/90; 415/198.1; 415/203

[58] Field of Search ..... 415/90, 120, 198, 203, 415/76; 416/183

[56] References Cited

U.S. PATENT DOCUMENTS

| | | | |
|---|---|---|---|
| 651,400 | 6/1900 | Trouve et al. | 415/90 |
| 1,056,338 | 3/1913 | Johnsen | 415/90 |
| 1,061,142 | 5/1913 | Tesla | 415/90 |
| 1,445,310 | 2/1923 | Hall | 415/90 |
| 1,975,568 | 10/1934 | Dubrovin | 415/90 |
| 2,087,834 | 7/1937 | Brown et al. | 415/90 |
| 3,228,344 | 1/1966 | Cooper | 416/183 |
| 3,478,691 | 11/1969 | Henry | 416/183 |

FOREIGN PATENT DOCUMENTS

| | | | |
|---|---|---|---|
| 115,282 | 4/1900 | Germany | 415/120 |
| 365,486 | 12/1938 | Italy | 415/90 |
| 16,041 | 1909 | United Kingdom | 415/203 |
| 331,142 | 6/1930 | United Kingdom | 415/90 |
| 128,235 | 1959 | U.S.S.R. | 415/90 |

*Primary Examiner*—C. J. Husar

*Attorney, Agent, or Firm*—Mason, Mason & Albright

[57] ABSTRACT

This invention relates to turbines wherein fluid pressure temperature energy is released, via its passage from a high-speed nozzle delivery mounted externally and tangentially, to closely-spaced together circular profiled sheet metal, or ceramic, plates, preferably plate members that have concave and convex surfaces, at least in part, which form high surface area bodies of revolution. An assembly of disc members form the turbine rotor within which the surface adhesion effect of the traversing fluid imparts rotation to the rotor before it is finally expelled through an exhaust duct formed by centrally disposed exits in the assembly. A spiral-like fence baffle on the rear face of the plates tie adjoining surfaces together and provide expanding fluid flow channels between adjacent plates.

8 Claims, 7 Drawing Figures

TURBINE

This invention relates to turbines of the type that use closely spaced plate members mounted on shafting, in place of buckets or blades as a principal means of momentum transfer from a fluid into usable energy. The use of disc members for this purpose is basically disclosed by Nikola Tesla, in U.S. Pat. No. 1,061,206.

Prior to the present application, such turbines were considered impractical because the fluid paths from the peripheries of discs or plates to the center of the rotor are normally unrestrained, resulting in eddies and some counter flow of fluid.

In the present invention, unproductive fluid motion and expansion is avoided with spiral-like fencing between adjacent plates to control the flow of fluid. The rotor is balanced by selecting the arrangement of the plates, and welding or otherwise securing the members together in the rotor's balanced state. The use of bolts or clamps is avoided and controlled fluid flow from rotor entry to exit by the spiral fencing greatly improves performance and efficiency by removing sources of turbulent flow and preventing eddy precipitation at onset; fences regulate also fluid velocity and expansion rates to be concordant with exhaust aperture.

It is an object of the present invention to provide, in a simple construction, greatly improved flow conditions in disc assembly rotors and to achieve considerable performance gains. A further object is to provide in a geometrical arrangement, a rotor design combining improved flow conditions with a simple assembly technique enabling assymmetrical mass moment effects to be arranged to cancel each other out and provide a well balanced dynamic and static rotating assembly in which the axis of rotation and inertial axis are virtually coincident.

Another object is to provide a rotor assembly of robust and rigid characteristics yet minimize material usage by eliminating clamping and inter-rotor shafting or bolting and achieve a high minimum whirling speed. Still another object is to provide better rotor load distribution from energy transmitting surfaces by use of spiral-like and inter-plate member attachment.

Another objective is to use non-planary rotor plate members in place of discs to reduce fluid pressure losses on entering and leaving the rotor inter-member gaps as fluid progresses to exhaust aperture, pressure loss being a function of the entry and exit flow angular change magnitude. Such departure from plate discs increase flow path length and fluid to rotor adhesion. One version can be a frustum of a cone (referred to as cone for brevity) but the invention is not limited thereto and can be any non-planary saucer-like shape.

These and other objects with attendant advantages of the present invention will become more readily apparent from the following descriptions accompanying drawings wherein.

Figure 1:
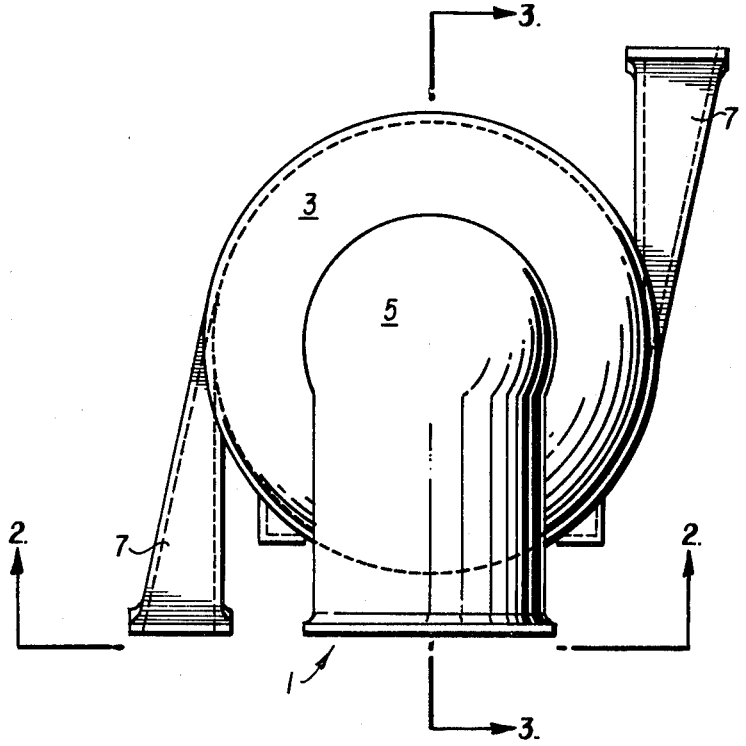
FIG. 1 is a front elevational view of the turbine.

In FIG. 1, the front of turbine 1 has a housing 3 and a forward exhaust elbow 5. Inlet means in the form of nozzle banks 7 comprise a plurality of individual passages 9 that can be helix in configuration. Thus, the passages 9 increase in cross-sectional area and can change from a generally rectangular shape at the outer ends of the banks to a flattened configuration at their entry points adjacent rotor 10. The effect is that the passages 9 are "twisted" to span substantially the entire width of rotor 20.

Figure 2:
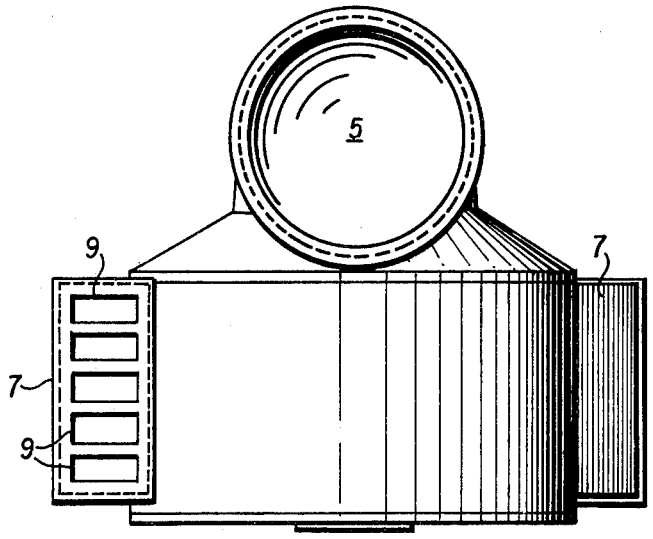
FIG. 2 is a bottom plan view taken on line 2—2 of FIG. 1.
Figure 3:
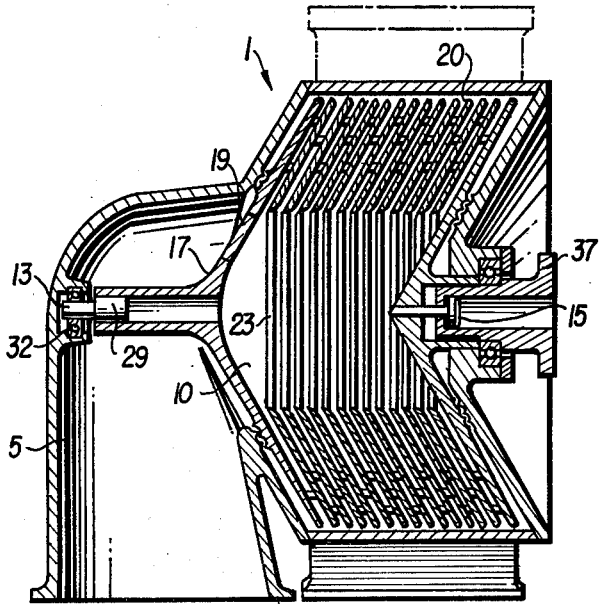
FIG. 3 is a longitudinal cross-section of the invention taken on line 3—3 of FIG. 1.
Figure 6:
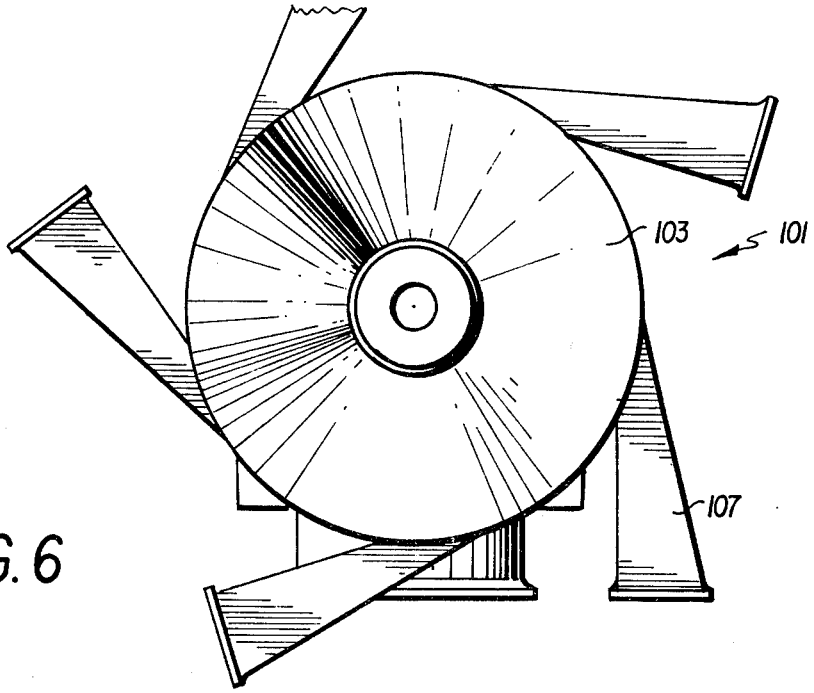
FIG. 6 is a rear elevation of a preferred turbine housing.

Two nozzle banks 7 are shown in FIGS. 1–3, but it is preferred that five banks of nozzles be formed in housing 3 about 70° apart around the rotor 10 as shown in FIG. 6. In each case, it is important that the nozzle banks be symmetrical with respect to the axis of rotation of rotor 10 which is afforded by a front stub shaft 13 and a rear coupling 33 that can be splined for connection to a generator or power conversion device.

Figure 4:
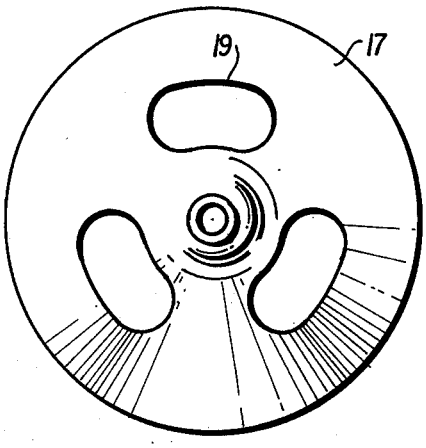
FIG. 4 is a front view of the front cone-shaped member.

The rotor 10 is formed by a front web 17 which can be a cone-shaped member with three kidney shaped exhaust holes 19 (FIG. 4) and a plurality of intermediate plate members 20. The members 20 each have a central exhaust hole 23 and a spiral fence baffles 25 on the rear face 27 thereof. It is convenient for illustration that the members 20 be cone-shaped or cone frustums as shown with an angle of about 20° –40°, preferably about 30° as seen in FIG. 3.

The plate members can be substantially flat discs but the preferred structure of the rotor includes interfitting plates that have inner concave and outer convex surfaces, at least in part. This preferred structure increases the strength of the rotor and has other advantages.

Figure 7:
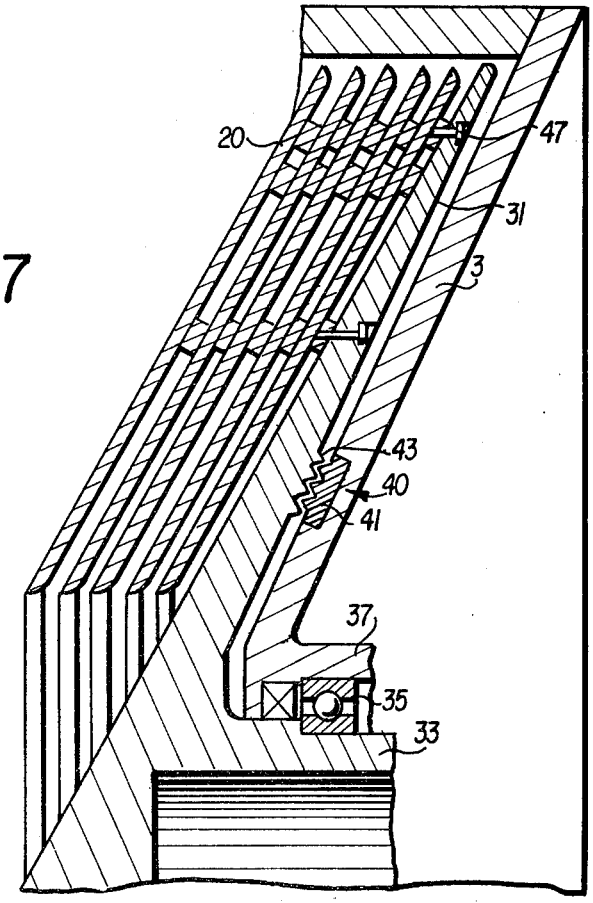
FIG. 7 is a section of the rear of the turbine housing and rotor.

The front web 17 of rotor 10 has a stem 29 which receives stub shaft 13 journalled in housing 3 with a bearing 32. The rear of rotor 10 has a master plate or cone-shaped member 31 with a central coupling 33 journalled in the rear of housing 3 with a bearing 35 in boss 37 at the center rear of the housing. A seal 40 is formed by a circular insert block of graphite 41 on the rear cover wall of housing 3 that is grooved by circular serrations 43 formed in the member 31 (FIG. 7). A similar seal exists between web 17 and the front of housing 3.

The plate or cone members 20 are interfitted or nested closely together to form an assembly with their spiral fence baffles 25 serving to space or separate the members 20 from one another. The rearmost member 20 is secured to master member 31 with pins 47.

The entire rotor 10 can be assembled by first balancing and then welding, brazing or otherwise bonding the front web 17, the intermediate members 20 and the master disc 31 together. Balancing can be achieved by staggering the locations of the fences 25 and shifting the members 20 with respect to one another around the axis of rotation of rotor 10.

Figure 5:
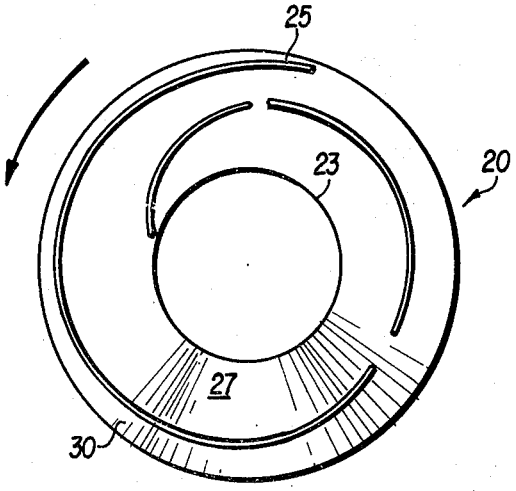
FIG. 5 is a rear view of an intermediate cone-shaped member showing spiral fencing on the rear surface thereof.

It will be noticed that the spiral fence baffle 25 on member 20 in FIG. 5 is broken into segments leaving several open spaces between the segments. Different fluids can require variations in fence geometry. For instance, in the case of a highly elastic fluid such as steam, multi-stage rotor arrangements are desirable. The discontinuous fence baffle 25 not only enables dynamic and static balancing, but also offers optional flow variations to accomodate different fluids or mixed flow such as wet steam and hot water or shaft rotational speed variations.

In FIG. 6, a turbine 101 is shown with a housing 103 having five banks of nozzles 107 symmetrically arranged around the axis of rotation of the rotor and this arrangement is preferred to only two banks of nozzles as seen in FIGS. 1–3. Except for the nozzles, the turbine 101 is the same as that described above.

One particular application of the turbine described above is in wet steam applications, such a geothermal steam. In such applications, wet steam often has particulates and upon expansion bladed turbines erode. With a defined channel boundary-layer turbine having closely spaced plate or cone members, the narrow interface expansion permitted for wet steam mitigates erosion. As virtually no fluid to direct surface impingement occurs within the turbine, and fluid contact is a sheet effect on surface boundary layer, component wear is negligible over considerable continuous use.

While the turbine disclosed herein can be driven by many fluids, its operation is best described in a steam application. Steam entering the nozzles is accelerated to a high velocity in the contracting passages 9. The accelerated steam exits from the passages at a vector to the periphery of rotor 10 and substantially tangent to the assembly of discs 20. The steam proceeds at high velocity into the narrow channels defined by the fence baffles 25 and the surfaces of adjacent discs.

Boundary layer adhesion of the rapidly rotating steam induces the rotor 10 to turn with the steam and there is little slippage between the steam and the rotor. The steam's energy in the form of pressure and temperature reduces with steam expansion as the steam enters increasingly larger portions of the channels. At the same time, the linear velocity of the steam also decreases as it proceeds to the exit openings of the members 20 to provide an approximate constant slip from disc periphery to exit.

The steam then proceeds out of openings to a much lower pressure in the exhaust elbow. Exhaust low pressure is maintained by conventional vacuum pump or venturi (not shown) and the usual reduction gearing can be interposed between coupling and the generator or other device to be driven.

The term "turbine" as used herein, also refers to turbo pumps, fans, compressors and the like which are driven instead of driving, i.e. the flow of luid is in an opposite direction than that described above.

I claim:

1. A turbine comprising a housing and a circular rotor journalled within said housing, fluid inlet means in said housing and said inlet means extending substantially tangentially with respect to said rotor, said rotor comprising an assembly of adjacent circular members and the rear faces of said circular members having raised spiral fence baffles that affix and space adjacent members with respect to one another and define an expanding fluid channel towards exhaust openings in the centers of these members, the openings of the circular members intermediate the end members of said assembly being obstruction-free and the axis of rotation of said rotor extending through said exhaust openings, a front end member of said rotor comprising a web with exhaust slots and having an outer convex side, a central stem on said convex side being journalled to said housing with shaft means, a rear end member of said rotor comprising a coupling that is journalled to the rear of said housing.

2. The turbine of claim 1, wherein said circular members have interfitting inner concave and outer convex surfaces.

3. The turbine of claim 2, wherein said circular members are cone frustums that nest within one another.

4. The turbine of claim 2, wherein the raised spiral fence baffles of adjacent circular members are staggered and said baffles extend for at least one revolution around the exhaust opening.

5. The turbine of claim 1, wherein said fluid inlet means includes at least two banks of nozzles that lead into said housing, said banks being located substantially symmetrically with respect to the axis of rotation of said rotor.

6. The turbine of claim 5, wherein there are five banks of nozzles that are located about 70° apart from one another around the axis of rotation.

7. The turbine of claim 1, wherein said fence baffles are formed by segments that are separated with open spaces.

8. The turbine of claim 1, wherein the rear of said housing is concave and the center thereof comprises a journal for said coupling.

* * * * *